US012285148B2

(12) United States Patent
Seok

(10) Patent No.: US 12,285,148 B2
(45) Date of Patent: Apr. 29, 2025

(54) CLEANING MODULE AND CLEANER COMPRISING SAME

(71) Applicant: LG ELECTRONICS INC., Seoul (KR)

(72) Inventor: Daehee Seok, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 257 days.

(21) Appl. No.: 17/787,102

(22) PCT Filed: Nov. 3, 2020

(86) PCT No.: PCT/KR2020/015242
§ 371 (c)(1),
(2) Date: Jun. 17, 2022

(87) PCT Pub. No.: WO2021/141223
PCT Pub. Date: Jul. 15, 2021

(65) Prior Publication Data

US 2023/0036328 A1 Feb. 2, 2023

(30) Foreign Application Priority Data

Jan. 9, 2020 (KR) ..... 10-2020-0003379

(51) Int. Cl.
*A47L 9/00* (2006.01)
*A47L 9/02* (2006.01)
*A47L 9/28* (2006.01)

(52) U.S. Cl.
CPC ..... *A47L 9/0072* (2013.01); *A47L 9/02* (2013.01); *A47L 9/2836* (2013.01); *A47L 9/2857* (2013.01)

(58) Field of Classification Search
CPC ..... A47L 9/02–0693; A47L 9/2847; A47L 9/2826; A47L 9/2821; A47L 9/0072;
(Continued)

(56) References Cited

U.S. PATENT DOCUMENTS 2,096,517 A * 10/1937 Hurley ..... A47L 9/0483 15/364
6,039,817 A * 3/2000 Payne ..... A47L 5/28 134/21
(Continued)

FOREIGN PATENT DOCUMENTS

CN 1868392 A 11/2006
CN 1939202 A 4/2007
(Continued)

*Primary Examiner* — Brian D Keller
*Assistant Examiner* — Sidney D Full
(74) *Attorney, Agent, or Firm* — Birch, Stewart, Kolasch & Birch, LLP

(57) ABSTRACT

Disclosed are a cleaning module and a cleaner comprising same. The cleaning module, according to one aspect of the present specification, comprises: a housing communicating with a suction port of a main body of the cleaner, and comprising a suction space exposed to a bottom surface; a first hole disposed on one side surface, perpendicular to a cleaning direction, of the housing; and a first opening/closing device comprising a first shielding member for enabling communication with the suction space by selectively opening/closing the first hole.

10 Claims, 18 Drawing Sheets

(58) Field of Classification Search
CPC .... A47L 9/0427; A47L 9/0444; A47L 9/0433; A47L 9/165; A47L 9/0488; A47L 11/38; A47L 11/4044
USPC ..... 15/416
See application file for complete search history.

(56) References Cited

U.S. PATENT DOCUMENTS

| | | | | |
|---|---|---|---|---|
| 7,552,507 | B2 * | 6/2009 | Burnham | A47L 9/04 15/419 |
| 2003/0000042 | A1 * | 1/2003 | Wang | A47L 9/0653 15/369 |
| 2008/0289141 | A1 * | 11/2008 | Oh | A47L 9/0488 15/354 |
| 2012/0167331 | A1 * | 7/2012 | Pruiett | A47L 9/2805 15/319 |
| 2016/0183746 | A1 * | 6/2016 | Krebs | A47L 7/0066 15/383 |

FOREIGN PATENT DOCUMENTS

| | | | |
|---|---|---|---|
| CN | 102210571 | A | 10/2011 |
| CN | 204734430 | U | 11/2015 |
| CN | 106974591 | A | 7/2017 |
| EP | 3 264 960 | B1 | 12/2018 |
| KR | 10-2003-0015014 | A | 2/2003 |
| KR | 10-2004-0085165 | A | 10/2004 |
| KR | 10-2010-0095041 | A | 8/2010 |

* cited by examiner

CLEANING MODULE AND CLEANER COMPRISING SAME

CROSS REFERENCE TO RELATED APPLICATIONS

This application is the National Phase of PCT International Application No. PCT/KR2020/015242, filed on Nov. 3, 2020, which claims priority under 35 U.S.C. 119 (a) to Patent Application No. 10-2020-0003379, filed in the Republic of Korea on Jan. 9, 2020, all of these applications being hereby expressly incorporated by reference into the present application.

TECHNICAL FIELD

The present disclosure relates to a cleaning module and a cleaner including the same, and more particularly, to a cleaning module for performing cleaning by sucking or wiping dust or foreign substances on a region to be cleaned, and a cleaner including the same.

BACKGROUND ART

In general, a cleaner refers to an electrical appliance that draws in small garbage or dust by sucking air using electricity and fills a dust bin provided in a product with the garbage or dust. Such a cleaner is generally called a vacuum cleaner.

The cleaners may be classified into a manual cleaner which is moved directly by a user to perform a cleaning operation, and an automatic cleaner which performs a cleaning operation while autonomously traveling. Depending on the shape of the cleaner, the manual cleaners may be classified into a canister cleaner, an upright cleaner, a handy cleaner, a stick cleaner, and the like.

The canister cleaners were widely used in the past as household cleaners. However, recently, there is an increasing tendency to use the handy cleaner and the stick cleaner in which a dust bin and a cleaner main body are integrally provided to improve convenience of use.

In the case of the canister cleaner, a main body and a suction port are connected by a rubber hose or pipe, and in some instances, the canister cleaner may be used in a state in which a brush is fitted into the suction port.

The hand vacuum cleaner has maximized portability and is light in weight. However, because the handy cleaner has a short length, there may be a limitation to a cleaning region. Therefore, the handy cleaner is used to clean a local place such as a desk, a sofa, or an interior of a vehicle.

A user may use the stick cleaner while standing and thus may perform a cleaning operation without bending his/her waist. Therefore, the stick cleaner is advantageous for the user to clean a wide region while moving in the region. The handy cleaner may be used to clean a narrow space, whereas the stick cleaner may be used to clean a wide space and also used to a high place that the user's hand cannot reach. Recently, modularized stick cleaners are provided, such that types of cleaners are actively changed and used to clean various objects.

In addition, recently, the hand vacuum cleaner and the stick vacuum cleaner are provided to be used in combination, so products that improve user convenience have been released.

The conventional cleaner is gripped by a user to clean a lower portion of the cleaning module in a cleaning progress direction. In this connection, in the case of an edge region of a cleaning space, there is an issue in that dust cannot be sucked due to a structural limitation of the cleaner.

DISCLOSURE

Technical Problem

An aspect of the present disclosure is directed to providing a cleaning module capable of sucking dust in an edge region of a cleaning space without changing a separate cleaning module, and a cleaner including the same.

Technical Solution

A cleaning module, according to one aspect of the present disclosure, includes: a housing communicating with a suction port of a main body of a cleaner, and including a suction space exposed to a bottom surface; a first hole disposed on one side surface, perpendicular to a cleaning direction, of the housing; and a first opening/closing device including a first shielding member for enabling communication with the suction space by selectively opening/closing the first hole.

Thus, since the dust in the edge region of the cleaning space can be sucked without changing a separate cleaning module, the convenience of a user can be increased.

In addition, the first opening/closing device may include a second shielding member selectively opening/closing a first space between the other side surface, perpendicular to the cleaning direction, of the housing and a central region of the housing.

In addition, when the first shielding member opens the first hole, the second shielding member may shield the first space, and when the first shielding member shields the first hole, the second shielding member may open the first space.

Thus, when the first shielding member opens the first hole, the second shielding member shields the first space, thereby improving the suction efficiency of dust on the outside of one side surface of the housing.

In addition, the first opening/closing device may include a first rotation gear rotating the first shielding member, a first driving gear spaced apart from the first rotation gear, a first belt wrapping the first rotation gear and the first driving gear, and a first motor rotating the first driving gear.

In addition, the first opening/closing device may include a second shielding member selectively opening/closing a first space between the other side surface, perpendicular to the cleaning direction, of the housing and a central region of the housing, and a second rotation gear rotating the second shielding member, and the first belt may wrap the first rotation gear, the first driving gear, and the second rotation gear.

In addition, the first rotation gear may include a first main gear wrapped by the first belt, and a first sub-gear which is engaged with the first main gear at a predetermined gear ratio and rotates the first shielding member.

In addition, a second hole disposed on the other side surface, perpendicular to the cleaning direction, of the housing; and a second opening/closing device including a third shielding member for enabling communication with the suction space by selectively opening/closing the second hole may be included.

Thus, since the dust in the edge region of the cleaning space can be sucked without changing a separate cleaning module, the convenience of a user can be increased.

In addition, the second opening/closing device may include a fourth shielding member selectively opening/ closing a second space between one side surface of the housing and a central region of the housing.

In addition, when the third shielding member opens the second hole, the fourth shielding member may shield the second space, and when the third shielding member shields the second hole, the fourth shielding member may open the second space.

Thus, when the third shielding member opens the second hole, the fourth shielding member shields the second space, thereby improving the suction efficiency of dust on the outside of one side surface of the housing.

In addition, the first opening/closing device and the second opening/closing device may operate independently.

In addition, the second opening/closing device may include a third rotation gear rotating the third shielding member, a second driving gear spaced apart from the third rotation gear, a second belt wrapping the third rotation gear and the second driving gear, and a second motor rotating the second driving gear.

In addition, the second opening/closing device may include a fourth shielding member selectively opening/closing a second space between one side surface of the housing and a central region of the housing, and a fourth rotation gear rotating the fourth shielding member, and the second belt may wrap the third rotation gear, the second driving gear, and the fourth rotation gear.

In addition, the third rotation gear may include a second main gear wrapped by the second belt, and a second sub-gear which is engaged with the second main gear at a predetermined gear ratio and rotates the third shielding member.

In addition, a first roller disposed on one side of the housing may be included.

In addition, a first elastic member disposed adjacent to the first hole and protruding outward from one side surface of the housing may be included, and an outer side surface of the first elastic member may be in contact with a wall surface.

In addition, an operation unit receiving an operation signal from a user; and a controller for driving the first opening/closing device according to the operation signal may be included.

The cleaning module, according to one aspect of the present disclosure, includes: a housing communicating with a suction port of a main body of a cleaner, and including a suction space exposed to a bottom surface; a first hole disposed on one side surface, perpendicular to a cleaning direction, of the housing; a first opening/closing device for enabling communication with the suction space by selectively opening/closing the first hole; a second hole disposed on the other side surface, perpendicular to the cleaning direction, of the housing; and a second opening/closing device for enabling communication with the suction space by selectively opening/closing the second hole, wherein the first opening/closing device and the second opening/closing device may operate independently.

Thus, since the dust in the edge region of the cleaning space can be sucked without changing a separate cleaning module, the convenience of a user can be increased.

In addition, an operation unit receiving an operation signal from a user; and a controller for driving the first opening/closing device or the second opening/closing device according to the operation signal may be included.

A cleaner, according to one aspect of the present disclosure, includes: a main body including a suction port; an extended pipe communicating with the suction port; and a cleaning module communicating with the extended pipe, wherein the cleaning module includes: a housing communicating with the suction port, and including a suction space exposed to a bottom surface; a first hole disposed on one side surface, perpendicular to a cleaning direction, of the housing; and a first opening/closing device for enabling communication with the suction space by selectively opening/closing the first hole.

Thus, since the dust in the edge region of the cleaning space can be sucked without changing a separate cleaning module, the convenience of a user can be increased.

In addition, the cleaning module may include: a second hole disposed on the other side surface, perpendicular to the cleaning direction, of the housing; and a second opening/closing device for enabling communication with the suction space by selectively opening/closing the second hole, wherein the first opening/closing device and the second opening/closing device may operate independently.

Advantageous Effects

In an embodiment of the present disclosure, it is possible to provide a cleaning module capable of sucking dust in an edge region of a cleaning space without changing a separate cleaning module, and a cleaner including the same.

MODE FOR DISCLOSURE

Figure 1:
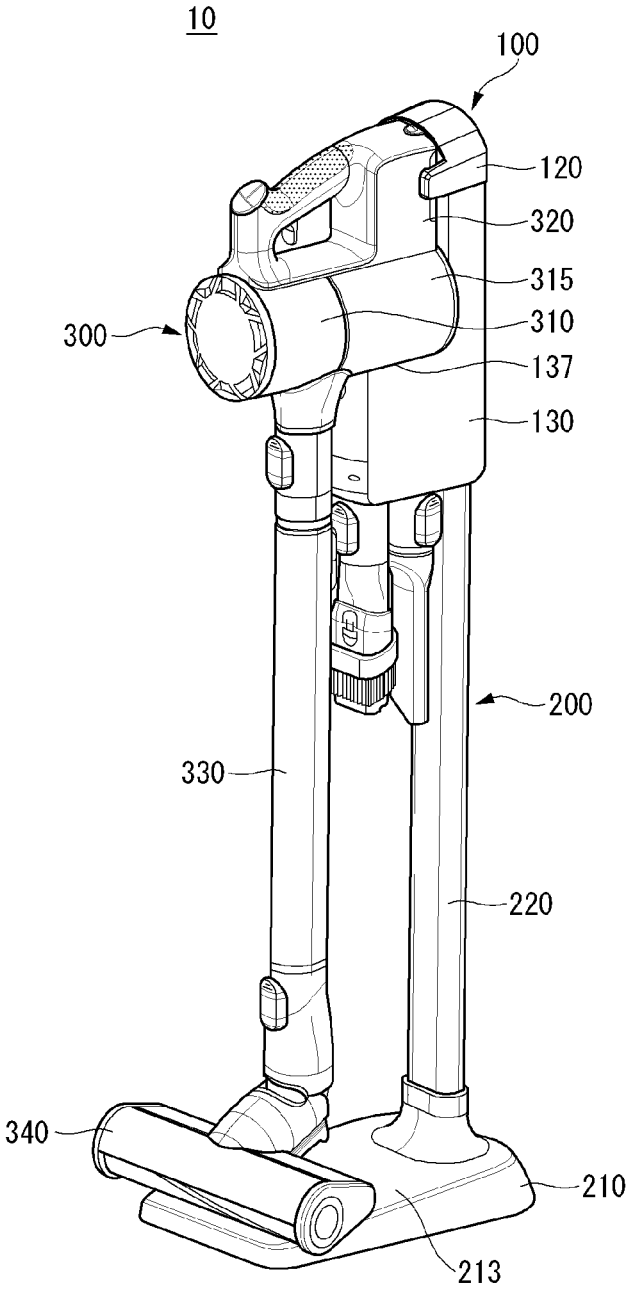
FIG. 1 is a perspective view of a cleaner system according to an embodiment of the present disclosure.

Hereinafter, embodiments of the present disclosure are described in more detail with reference to accompanying drawings and regardless of the drawings symbols, same or similar components are assigned with the same reference numerals and thus overlapping descriptions therefor are omitted.

However, the technical spirit of the present disclosure is not limited to some embodiments described, but may be implemented in various different forms, and within the scope of the technical spirit of the present disclosure, one or more of the components may be selectively combined or substituted between embodiments.

In addition, the terms (including technical and scientific terms) used in the embodiments of the present disclosure, unless explicitly defined and described, may be interpreted as having the meanings as commonly understood by those skilled in the technical field to which the present disclosure pertains, and commonly used terms such as terms defined in the dictionary may be interpreted in consideration of the meanings of the context of the related technology.

In addition, the terms used in the embodiments of the present disclosure are for describing embodiments and are not intended to limit the present disclosure.

In the present disclosure, the singular forms may also include plural forms unless otherwise specifically stated in a phrase, and in the case in which "at least one (or one or more) of A and B, C" is described, it may include one or more of all combinations that may be combined with A, B, and C.

In addition, in the description of the components of the embodiment of the present disclosure, the terms such as first, second, A, B, (a), and (b) may be used. These terms are merely used to distinguish the components from other components, and do not delimit an essence, an order or a sequence of the corresponding components.

In addition, when it is described that one component is "connected", "coupled", or "jointed" to another component, the description may include not only being directly connected, coupled or joined to the other component but also being "connected" "coupled" or "joined" by another component between the component and the other component.

In addition, in the case of being described as being formed or disposed "above (on)" or "below (under)" of each component, the description includes not only when two components are in direct contact with each other, but also when one or more other components are formed or disposed between the two components. In addition, when expressed as "above (on)" or "below (under)," it may refer to a downward direction as well as an upward direction with respect to one component.

In addition, a term of "disclosure" may be replaced by document, specification, description, etc.

Figure 2:
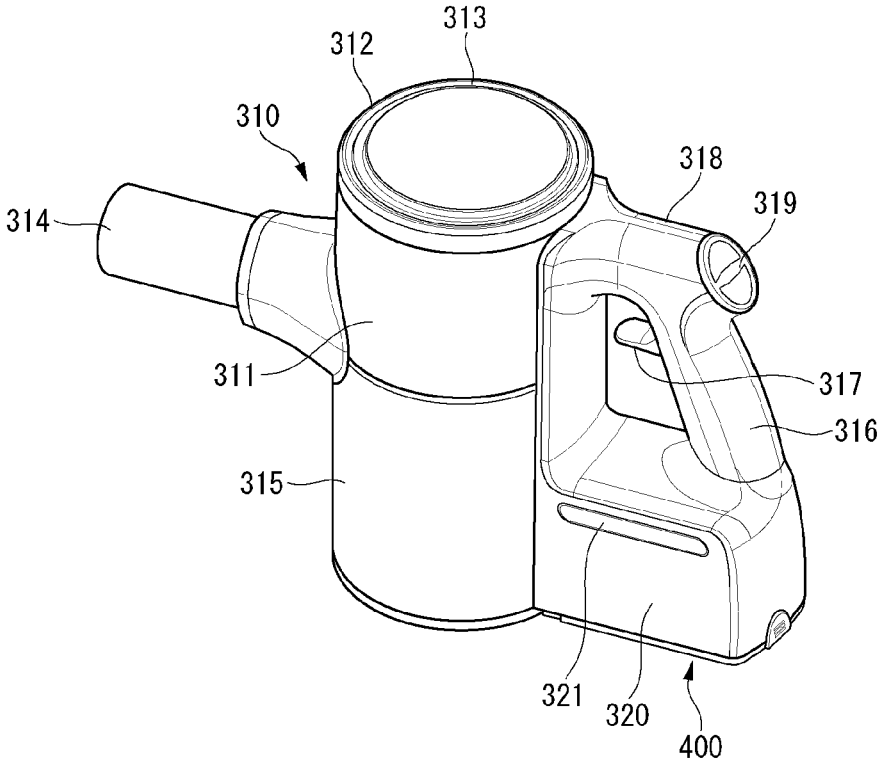
FIG. 2 is a perspective view of a main body of a cleaner according to an embodiment of the present disclosure.
Figure 3:
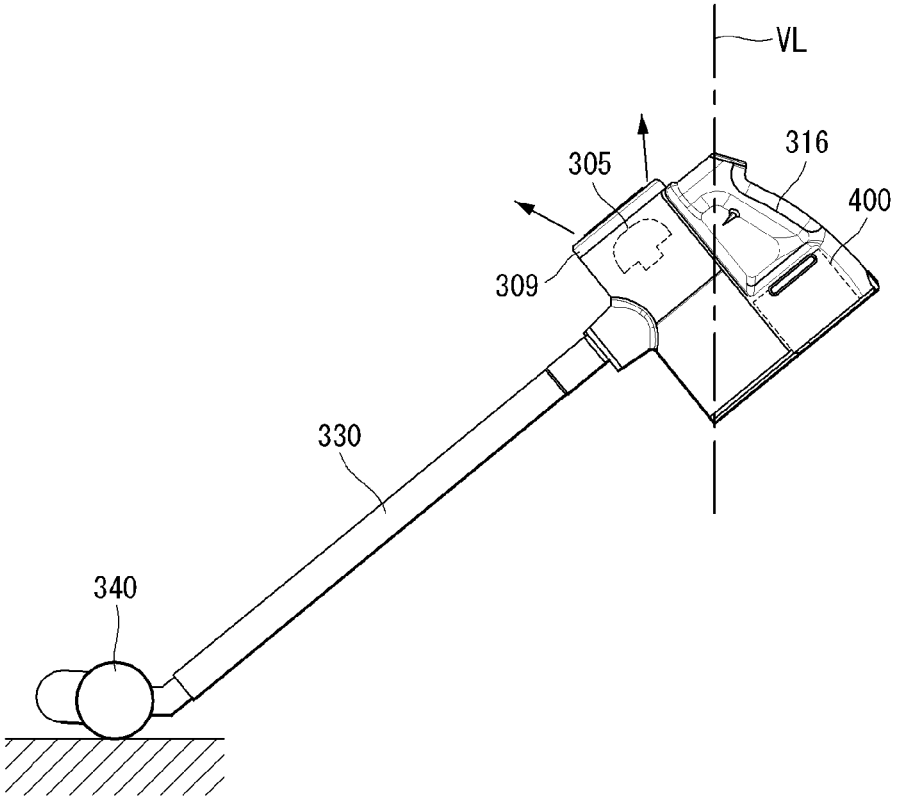
FIG. 3 is a view illustrating a state of cleaning a floor using a cleaner according to an embodiment of the present disclosure.

FIG. 1 is a perspective view of a cleaner system according to an embodiment of the present disclosure. FIG. 2 is a perspective view of a main body of a cleaner according to an embodiment of the present disclosure. FIG. 3 is a view illustrating a state of cleaning a floor using a cleaner according to an embodiment of the present disclosure.

Referring to FIGS. 1 to 3, a cleaner system 10 according to an embodiment of the present disclosure may include a charger 100, a stand 200, and a cleaner 300. The cleaner system may be implemented without some of the above configurations, and other additional configurations are not excluded.

The charger 100 may be disposed on the stand 200. The charger 100 may be supported by the stand 200. The charger 100 may be detachably coupled to the stand 200. The cleaner 300 may be coupled to the charger 100. The charger 100 may charge a battery 400 of the cleaner 300.

The charger 100 may include a main body 130. The main body 130 may include a charging terminal. The charging terminal of the main body 130 may be in contact with a terminal of the cleaner 300 to charge the battery 400 built in the cleaner 300.

An extra cleaning module may be coupled to the main body 130. The extra cleaning module may be detachably coupled to the cleaner 300. In general, the cleaner 300 may be provided with a cleaning module 340 and an extra replaceable cleaning module in various ways depending on the purposes. Accordingly, it is possible to reduce the risk of loss by storing the unused extra cleaning module in a state coupled to the main body 130. The extra cleaning module may be referred to as an "accessory."

The charger 100 may include a locking unit 120. The locking unit 120 may be disposed on an upper side of the first main body 130. The locking unit 120 may be coupled to the cleaner 300 to stably fix the cleaner 300. The locking unit 120 may include a plurality of locking members spaced apart in a horizontal direction. The main body 310 of the cleaner 300 may be inserted into a space between the plurality of locking members from above. In this connection, an outer side surface of the main body 310 of the cleaner 300 may be slidably coupled to an inner side surface of the locking unit 120. A sliding groove may be formed on the inner side surface of the locking unit 120, and a sliding protrusion that slides into the sliding groove of the locking unit 120 may be formed on the outer side surface of the main body 310 of the cleaner 300. Conversely, the sliding protrusion may also be formed on the inner side surface of the locking unit 120, and the sliding groove may also be formed on the outer side surface of the main body 310 of the cleaner 300.

The stand 200 may support the charger 100. The stand 200 may be detachably coupled to the charger 100. The stand 200 may support the cleaner 300. The stand 200 may be formed to extend in a vertical direction.

The stand 200 may include a base 210. The base 210 may be seated on a bottom surface. A support 220 may be disposed on the base 210. The base 210 may be formed in a hexahedral shape in which at least a portion of the lower portion is open.

The base 210 may include an inclined surface 213 on which the cleaning module 340 of the cleaner 300 is mounted. The inclined surface 213 may form a predetermined angle with the ground.

The stand 200 may include the support 220. The support 220 may be disposed on the base 210. The support 220 may be coupled to the base 210. A lower portion of the support 220 may be coupled to the base 210. The support 220 may extend in a vertical direction. The charger 100 may be detachably connected to the support 220. An upper portion of the support 220 may be coupled to the charger 100. The upper portion of the support 220 may be coupled to the charger 100 at the lower portion of the center of gravity of the charger 100. Thus, the support 220 may stably support the charger 100.

The cleaner 300 may be mounted on the stand 200. The cleaner 300 may be supported by the stand 200. The cleaner 300 may be coupled to the charger 100.

The cleaner 300 may include the main body 310. The main body 310 may include a suction motor 305. The main body 310 may be connected to an extended pipe 330. The main body 310 may be connected to the cleaning module 340 through the extended pipe 330. The main body 310 may generate suction force through the suction motor 305, and may provide the suction force to the cleaning module 340 through the extended pipe 330. External dust may be introduced into the main body 310 through the cleaning module 340 and the extended pipe 330. External dust may be introduced into the main body 310 through the cleaning module 340 and the extended pipe 330.

The main body 310 may include a suction unit 314. The suction unit 314 may protrude to an outside of the main body 310. The suction unit 314 may be formed in a cylindrical shape with an open inside. The suction unit 314 may communicate with the extended pipe 330. The suction unit 314 may suck in air containing dust.

The main body 310 may include a dust separation unit 311. The dust separation unit 311 may communicate with the suction unit 314. The dust separation unit 311 may separate dust sucked inside through the suction unit 314. The dust separation unit 311 may communicate with a dust bin 315. For example, the dust separation unit 311 may include a cyclone unit capable of separating dust by cyclone flow. The cyclone unit may communicate with the suction unit 314. Air and dust sucked in through the suction unit 314 are spirally flowed along an inner circumferential surface of the cyclone unit. An axis of the cyclone flow of the cyclone unit may extend in an up-down direction.

The main body 310 may include a dust bin 315. The dust bin 315 may communicate with the dust separation unit 311. The dust bin 315 may store the dust separated by the dust separation unit 311.

The main body 310 may include a discharge cover 309 having an air discharge port 312 through which air is discharged from the suction motor 305. A HEPA filter for filtering air may be accommodated in the discharge cover 309. A flow guide 313 may be disposed on the discharge cover 309. The flow guide 313 may guide the flow of air discharged through the air discharge port 312.

The cleaner 300 may include a handle 316. The handle 316 may be gripped by a user. The handle 316 may be disposed behind the suction motor 305. In other words, an axis of the suction motor 305 may be disposed between the suction unit 314 and the handle 316. In an embodiment of the present disclosure, the term "ahead" may refer to a direction in which the suction unit 314 is disposed with respect to the suction motor 305, and the term "behind" may refer to a direction in which the handle 316 is disposed. The upper surface of the handle 316 may form a portion of the external appearance of the upper surface of the cleaner 300. Thus, when the user grips the handle 316, it is possible to prevent any component of the cleaner 300 from coming into contact with the user's arm.

The cleaner 300 may include an extension 318. The extension 318 may extend from the handle 316 towards the suction motor 305. At least a portion of the extension 318 may extend in a horizontal direction.

The cleaner 300 may include a stopper 317. The stopper 317 may be disposed on the handle 316. The stopper 317 may be disposed on one side of the handle 316 facing the main body 310. The stopper 317 may serve to prevent a user's hand from moving in the longitudinal direction or the vertical direction of the handle 316. The stopper 317 may be spaced apart from the extension 318. In other words, in the state of gripping the handle 316, some fingers of the user may be positioned above the stopper 317, and the remaining fingers may be positioned under the stopper 317. For example, the stopper 317 may be positioned between the index finger and the middle finger.

The cleaner 300 may include an operation unit 319. The operation unit 319 may be disposed on the handle 316. The operation unit 319 may be disposed on an inclined surface formed in an upper region of the handle 316. A user may input an operation or stop instruction of the cleaner 300 through the operation unit 319.

The cleaner 300 may include a battery housing 320. The battery 400 may be accommodated in the battery housing 320. The battery housing 320 may be disposed on a lower side of the handle 316. The battery housing 320 may have a hexahedral shape with an open bottom. A rear surface of the battery housing 320 may be connected to the handle 316.

The cleaner 300 may include an extended pipe 330. The extended pipe 300 may communicate with the cleaning module 340. The extended pipe 330 may communicate with the main body 310. The extended pipe 330 may communicate with the suction port 314 of the main body 310. The extended pipe may be formed in an elongated cylindrical shape.

The cleaner 300 may include the cleaning module 340. The cleaning module 340 may communicate with the extended pipe 330. External air may be introduced into the main body 310 of the cleaner 300 through the cleaning module 340 and the extended pipe 330 by the suction force generated in the main body 310 of the cleaner 300.

The cleaner system 10 may include the battery 400. The battery 400 may be detachably coupled to the cleaner 300. The battery 400 may be detachably coupled to the battery housing 320. For example, the battery 400 may be inserted into the battery housing 320 from below the battery housing 320. The battery 400 may supply power to the suction motor 305 of the cleaner 300.

The battery 400 may be disposed under the handle 316. The battery 400 may be disposed behind the dust bin 315. In other words, the suction motor 305 and the battery 400 are disposed so as not to overlap in the vertical direction, and the arrangement height may also be different. With the handle 316 therebetween, the heavy suction motor 305 is disposed ahead of the handle 316, and the heavy battery 400 is disposed under the handle 316, so weight may be uniformly distributed throughout the cleaner 1. Thus, it is possible to prevent a strain on a user's wrist when the user cleans with the handle 316 in his/her hand.

Referring to FIG. 3, the extended pipe 330 may be connected to the suction port 314 of the cleaner 300, and the cleaning module 340 may be coupled to a lower side of the extended pipe 330. In this state, a user may clean by gripping the handle 316 while placing the cleaning module 340 on the floor to move the cleaning module 340.

When a user cleans using the cleaning module 340, in a state where the angle between the longitudinal axis of the extended pipe 330 or the suction unit 314 and the floor is approximately 45 degrees, the angle between the extended pipe 330 and the floor may be increased or decreased.

When a user cleans using the cleaning module 340, the height of the suction motor 305 and the battery 400 from the floor may be almost the same. When the user cleans the floor while gripping the handle 316, the weight of the cleaner 300 is balanced back and forth based on the user's hand gripping the handle 316, thereby maintaining a weight balance. Thus, it is possible to improve the user's convenience and prevent the user's wrist from being strained.

When a user cleans using the cleaning module 340, the discharge cover 309 may positioned ahead of a vertical line VL and the user's hand holding the handle 316 may be positioned behind the vertical line VL. The air discharged through the discharge cover 309 flows away from the handle 316, so it is possible to prevent the air discharged through the discharge cover 309 from flowing to the user's hand.

Figure 4:
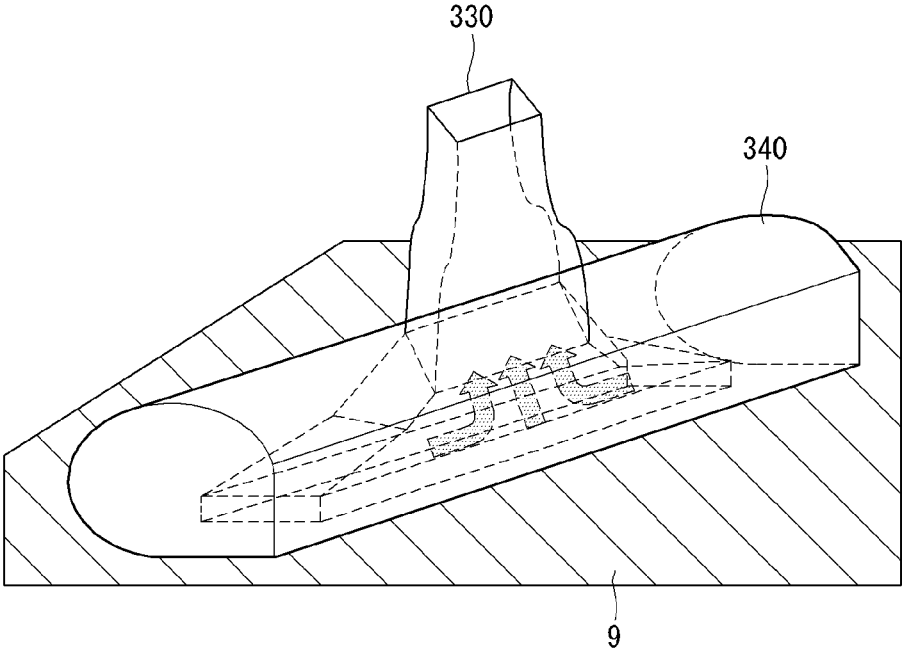
FIG. 4 is a perspective view of a cleaning module according to an embodiment of the present disclosure.
Figure 5:
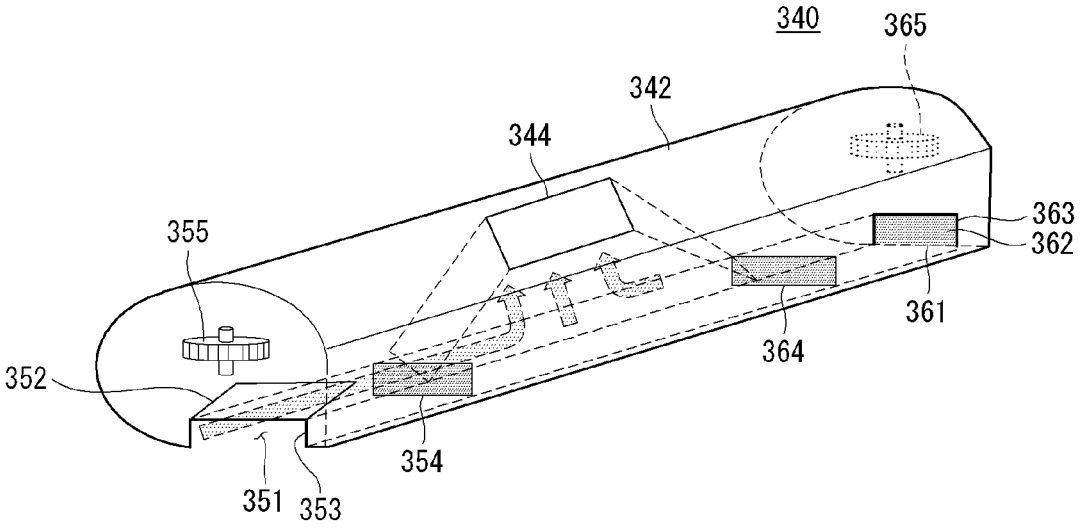
FIG. 5 is a schematic view of a cleaning module according to an embodiment of the present disclosure.
Figure 6:
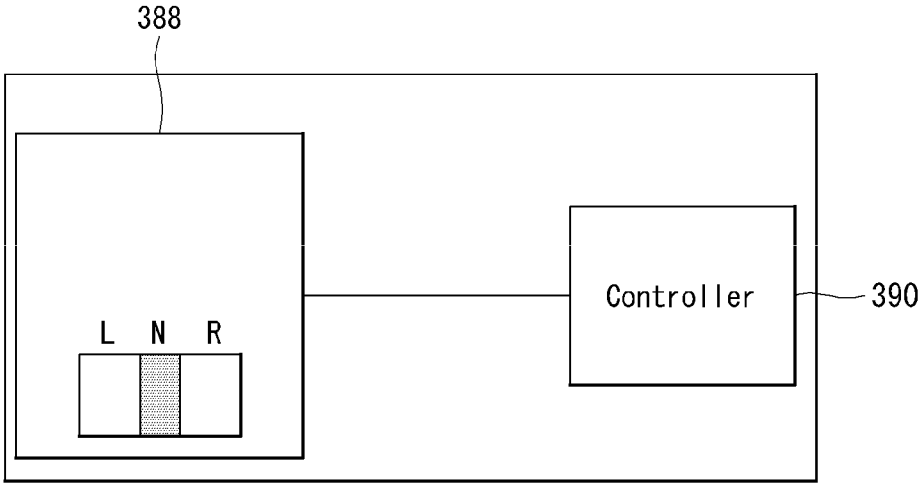
FIG. 6 is a block view of a cleaner according to an embodiment of the present disclosure.
Figure 7:
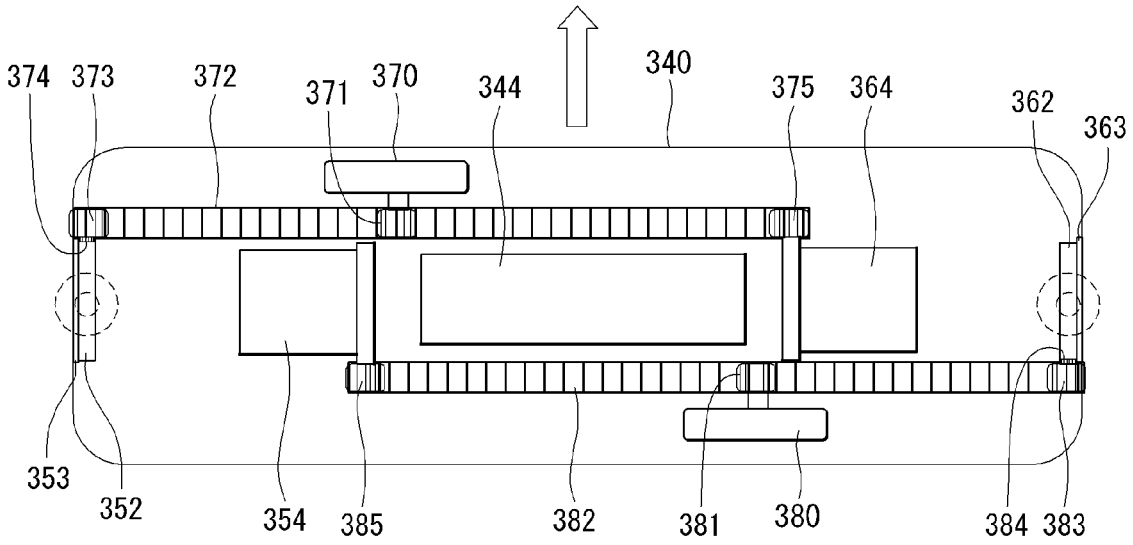
FIG. 7 is a plan view of a cleaning module according to an embodiment of the present disclosure.
Figure 8:
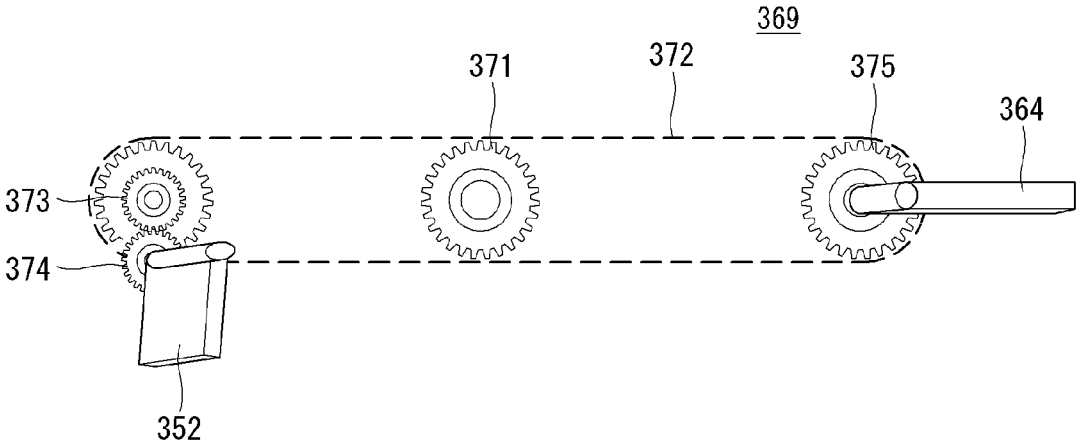
FIGS. 8 and 9 are partial cross-sectional views of a cleaning module according to an embodiment of the present disclosure.
Figure 9:
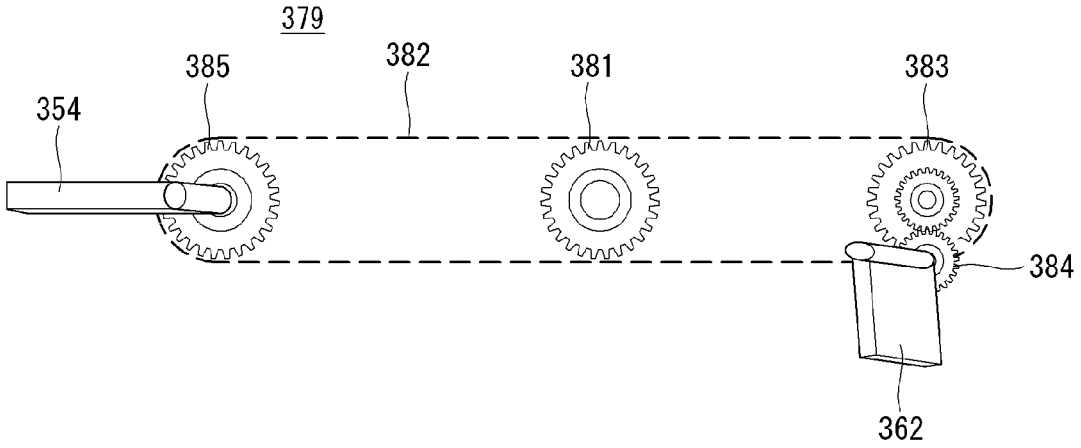
Figure 10:
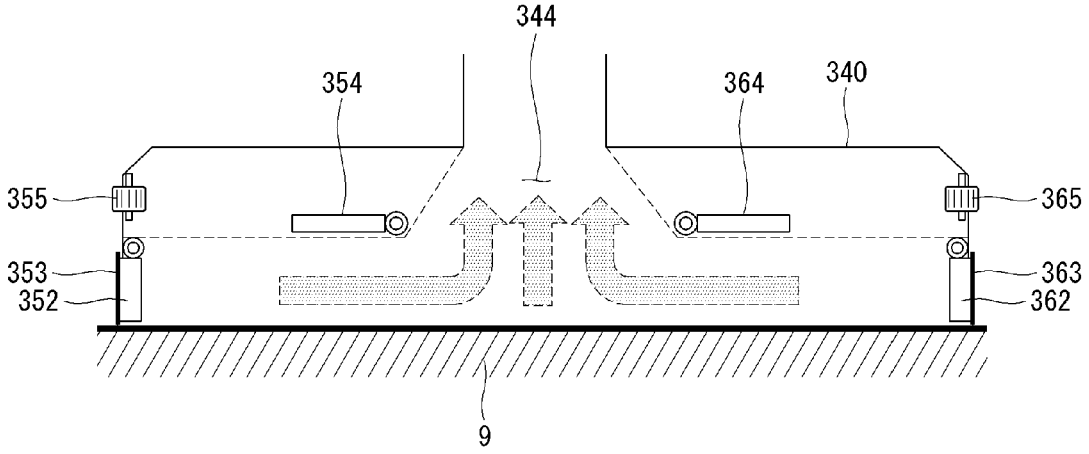
FIG. 10 is a cross-sectional view of a cleaning module according to an embodiment of the present disclosure.
Figure 11:
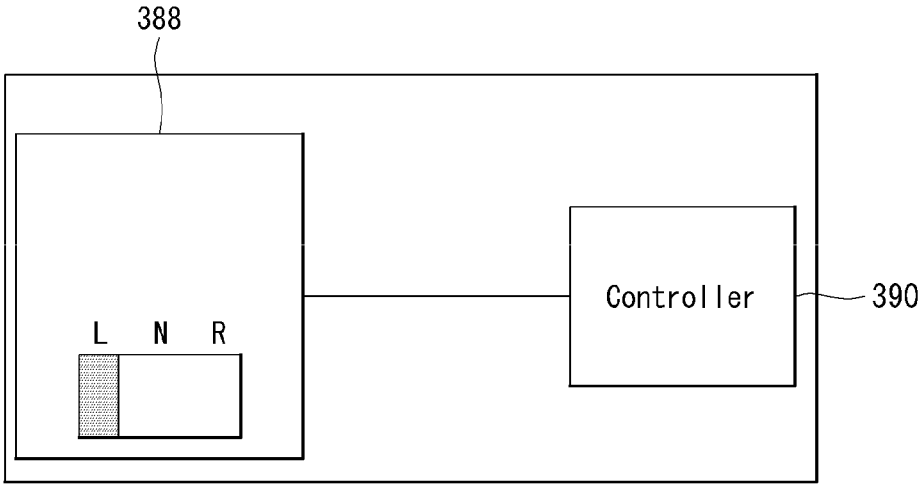
FIGS. 11 to 18 are operational views of a cleaning module according to an embodiment of the present disclosure.
Figure 12:
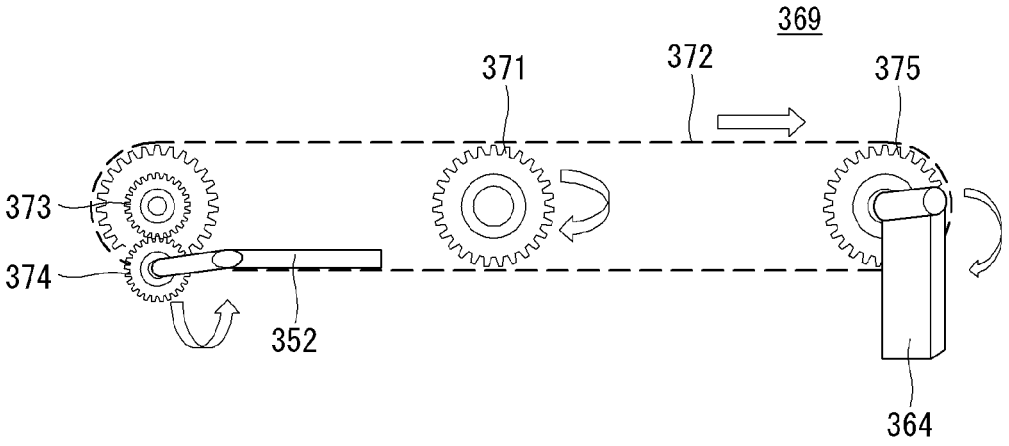
Figure 13:
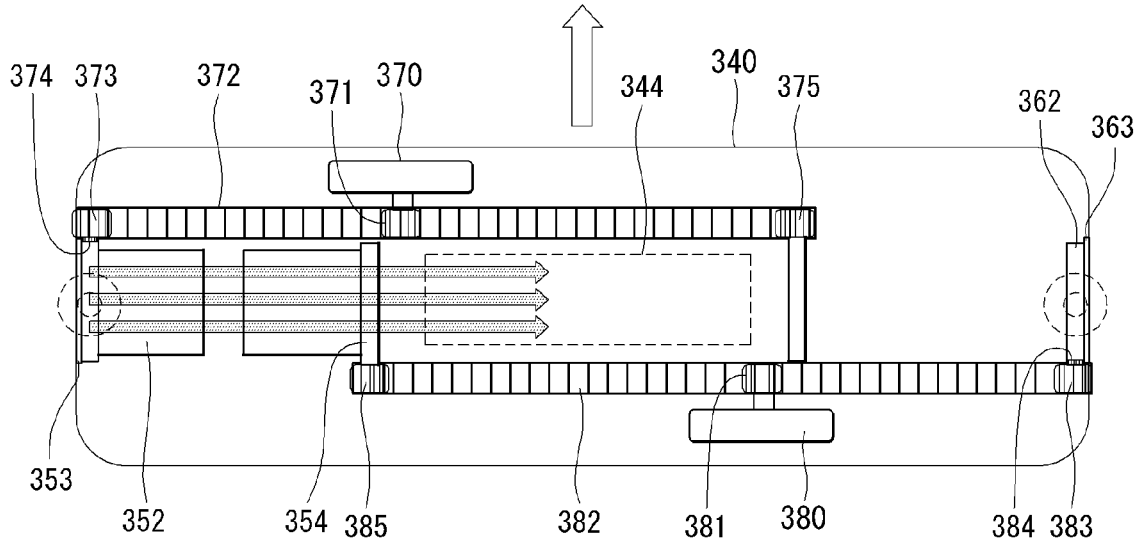
Figure 14:
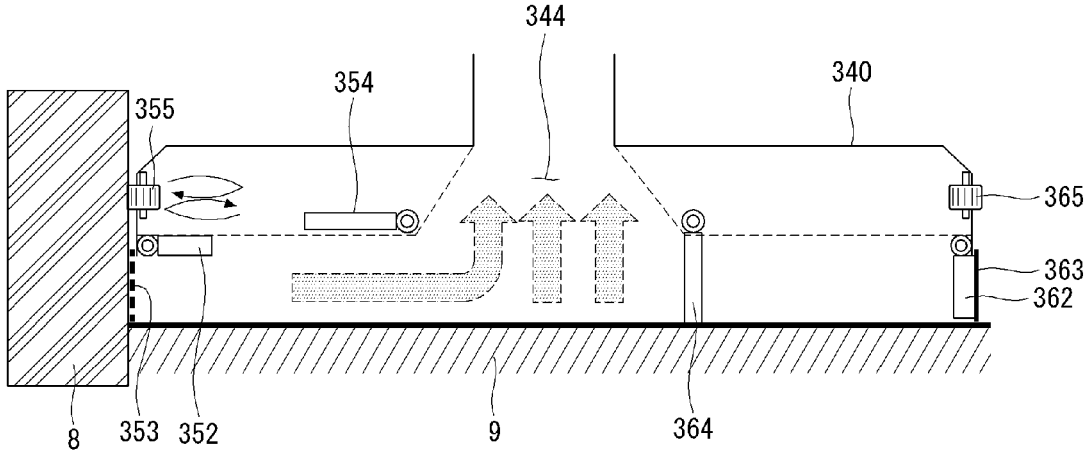
Figure 15:
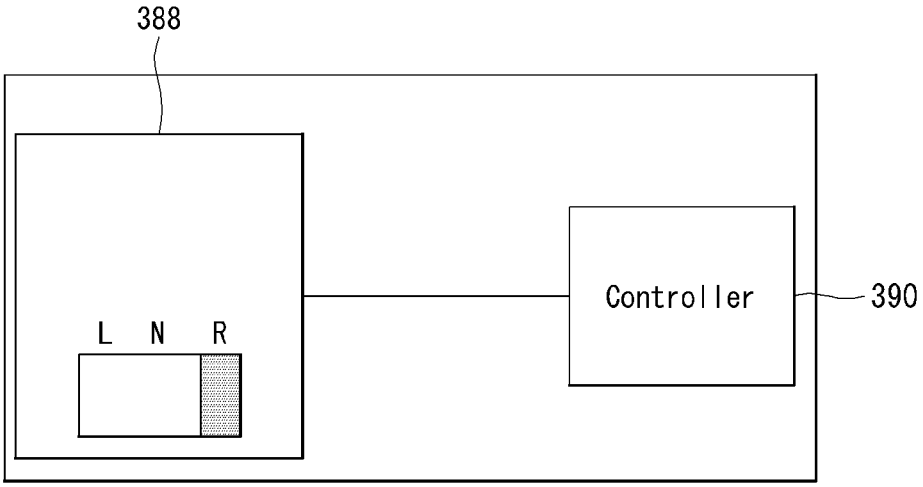
Figure 16:
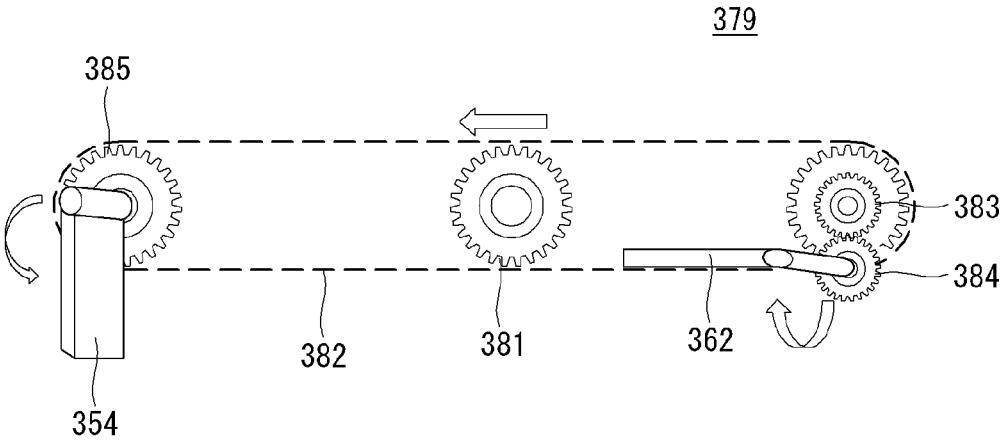
Figure 17:
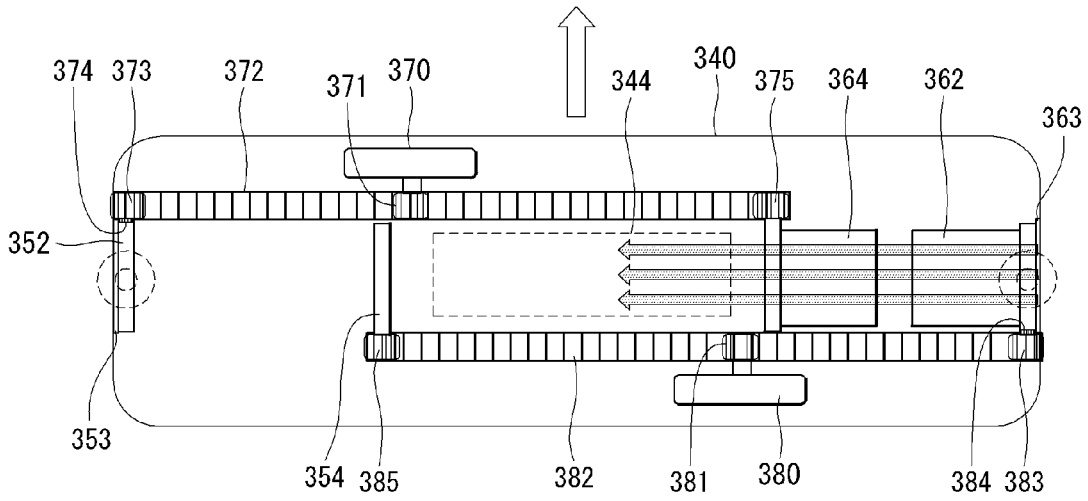
Figure 18:
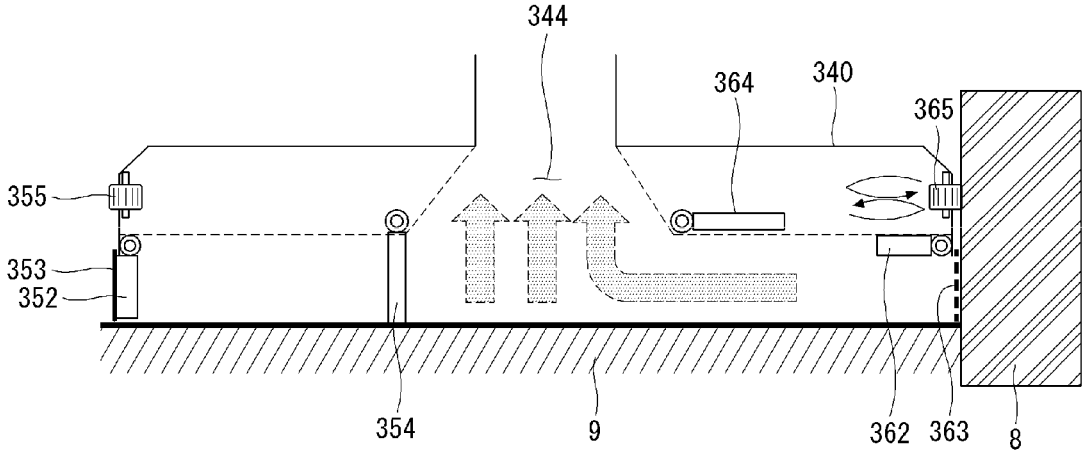

FIG. 4 is a perspective view of a cleaning module according to an embodiment of the present disclosure. FIG. 5 is a schematic view of a cleaning module according to an embodiment of the present disclosure. FIG. 6 is a block view of a cleaner according to an embodiment of the present disclosure. FIG. 7 is a plan view of a cleaning module according to an embodiment of the present disclosure. FIGS. 8 and 9 are partial cross-sectional views of a cleaning module according to an embodiment of the present disclosure. FIG. 10 is a cross-sectional view of a cleaning module according to an embodiment of the present disclosure. FIGS. 11 to 18 are operational views of a cleaning module according to an embodiment of the present disclosure.

Referring to FIGS. 4 to 18, the cleaning module 340 according to an embodiment of the present disclosure may include a housing 342, a first hole 351, a second hole 361, a first opening/closing device 369, a second opening/closing device 379, a first elastic member 353, a second elastic member 363, a first roller 355, a second roller 365, an operation unit 388, and a controller 390. The cleaning module may be implemented without some of the above configurations, and other additional configurations are not excluded.

The cleaning module 340 may include the housing 342. The housing 342 may form the external appearance of the cleaning module 340. The housing 342 may be connected to the extended pipe 330. When a user grips the handle 316 of the cleaner 300, moves the cleaning module 340 in a cleaning direction, and operates the cleaner 300, the housing 342 may be disposed in contact with or adjacent to a bottom surface 9 of the cleaning space to suck dust in the cleaning space.

The housing 342 may include a suction space 344. The suction space 344 may communicate with the suction unit 314 of the main body 310 of the cleaner 300. The suction space 344 may receive suction force from the suction motor 305. A lower portion of the suction space 344 may be exposed as a bottom surface of the housing 342. Thus, the cleaning module 340 may suck the dust in the cleaning space.

The cleaning module 340 may include the first hole 351. The first hole 351 may be disposed at a position perpendicular to the cleaning direction of the cleaning module 340 with respect to the suction space 344. The first hole 351 may be disposed on one side of the housing 342. The first hole 351 may expose the inside of the housing 342. The first hole 351 may expose the suction space 344 to one side of the housing 342. The first hole 351 may be selectively opened and closed through the first opening/closing device 369. The first hole 351 may be selectively opened and closed through a first shielding member 352. The first hole 351 may be disposed opposite to the second hole 361 with respect to the suction space 344. In an embodiment of the present disclosure, the first hole 351 is illustrated in a rectangular shape, but is not limited thereto and the shape of the first hole 351 may be variously changed.

The cleaning module 340 may include the second hole 361. The second hole 361 may be disposed at a position perpendicular to the cleaning direction of the cleaning module 340 with respect to the suction space 344. The second hole 361 may be disposed on the other side of the housing 342. The second hole 361 may expose the inside of the housing 342. The second hole 361 may expose the suction space 344 to the other side of the housing 342. The second hole 351 may be selectively opened and closed through the second opening/closing device 379. The second hole 351 may be selectively opened and closed through a third shielding member 362. The second hole 361 may be disposed opposite to the first hole 351 with respect to the suction space 344. In an embodiment of the present disclosure, the second hole 361 is illustrated in a rectangular shape, but is not limited thereto and the shape of the second hole 361 may be variously changed.

The cleaning module 340 may include the first opening/closing device 369. The first opening/closing device 369 may be disposed on the housing 342. The first opening/closing device 369 may be disposed in the housing 342. The first opening/closing device 369 may selectively open and close the first hole 351. The first opening/closing device 369 may be electrically connected to the controller 390. The first opening/closing device 369 may be operated by the controller 390 according to a user's operation signal.

The first opening/closing device 369 may include the first shielding member 352. The first shielding member 352 may be disposed in the housing 342. The first shielding member 352 may be disposed on one side of the housing 342. The first shielding member 352 may be rotatably disposed in the housing 342. The first shielding member 352 may selectively open and close the first hole 351. The first shielding member 352 may open or block the first hole 351 by a first motor 370. The first shielding member 352 may be connected to first rotation gears 373 and 374. The first shielding member 352 may open or block the first hole 351 by rotating according to the rotation of the first rotation gears 373 and 374. In an embodiment of the present disclosure, the first shielding member 352 is described by taking a rectangular shape as an example, but when the first hole 351 is able to be selectively opened and closed, the shape of the first shielding member 352 may be variously changed.

The first opening/closing device 369 may include a second shielding member 364. The second shielding member 364 may be disposed in the housing 342. The second shielding member 364 may be disposed on the other side of the housing 342. Specifically, the second shielding member 364 may shield the first space between the other side surface of the housing 342 and the central region of the suction space 344. When the first shielding member 352 opens the first hole 351, the second shielding member 364 shields the first space, so that the efficiency of sucking air and dust from one side of the housing 342 through the first hole 351 may be improved. In an embodiment of the present disclosure, the second shielding member 364 is described by taking a rectangular shape as an example, but when the first space is able to be shielded, the shape of the second shielding member 364 may be variously changed.

The first opening/closing device 369 may include the first motor 370. The first motor 370 may be connected to a first driving gear 371. Specifically, the first motor 370 may share a rotational axis with the first driving gear 371. The first motor 370 may rotate the first driving gear 371. For example, the first motor 370 may rotate the first driving gear 371 in one direction or rotate the same in the other direction.

The first opening/closing device 369 may include the first driving gear 371. The first driving gear 371 may be connected to the first motor 370. Specifically, the first driving gear 371 may share a rotational axis with the first motor 370. The first driving gear 371 may receive driving force from the first motor 370 to rotate in one direction or the other direction. The first driving gear 371 may be connected to a first belt 372. The first driving gear 371 may be wrapped from the first belt 372. The first driving gear 371 may rotate the first belt 372. Specifically, when the first driving gear 371 rotates in one direction, the first belt 372 may rotate in one direction, and when the first driving gear 371 rotates in the other direction, the first belt 372 may rotate in the other direction.

The first opening/closing device 369 may include the first belt 372. The first belt 372 may wrap the first driving gear 371, the first rotation gears 373 and 374, and the second rotation gear 375. The first belt 372 may rotate in one direction when the first driving gear 371 rotates in one direction, and rotate in the other direction when the first driving gear 371 rotates in the other direction. The first belt 372 may rotate the first rotation gears 373 and 374. Specifically, when the first belt 372 rotates in one direction, the first belt 372 may rotate the first rotation gears 373 and 374 in one direction, and when the first belt 372 rotates in the other direction, the first belt 372 may rotate the first rotation gears 373 and 374 in the other direction. The first belt 372 may rotate the second rotation gear 375. Specifically, when the first belt 372 rotates in one direction, the first belt 372 may rotate the second rotation gear 375 in one direction, and when the first belt 372 rotates in the other direction, the first belt 372 may rotate the second rotation gear 375 in the other direction. In an embodiment of the present disclosure, the first belt 372 is described by taking as an example a chain belt caught by each tooth of the first driving gear 371, the first rotation gears 373 and 374, and the second rotation gear 375, but is not limited thereto and may be variously changed.

The first opening/closing device 369 may include the first rotation gears 373 and 374. The first rotation gears 373 and 374 may be wrapped by the first belt 372. The first rotation gears 373 and 374 may be rotated by the first belt 372. Specifically, the first rotation gears 373 and 374 may rotate in one direction or the other direction by the first belt 372. The first rotation gears 373 and 374 may be connected to the first shielding member 352. Specifically, the first rotation gears 373 and 374 may share a rotational axis with the first shielding member 352. In the first rotation gears 373 and 374, when the first belt 372 rotates in one direction, the first shielding member 352 may open the first hole 351, and when the first belt 372 rotates in the other direction, the first shielding member 352 may block the first hole 351. In an embodiment of the present disclosure, one direction may mean a clockwise direction and the other direction may mean a counterclockwise direction, but are not limited thereto.

The first rotation gears 373 and 374 may include a first main gear 373. The first main gear 373 may be wrapped by the first belt 372. The first main gear 373 may be rotated by the first belt 372. Specifically, the first main gear 373 may be rotated in one direction or the other direction by the first belt 372. The first main gear 373 may be engaged with a first sub-gear 374.

The first rotation gears 373 and 374 may include the first sub-gear 374. The first sub-gear 374 may be engaged with the first main gear 373. The first sub-gear 374 may be connected to the first shielding member 352. Specifically, the first sub-gear 374 may share a rotational axis with the first shielding member 352. The first sub-gear 374 may rotate in the other direction when the first main gear 373 rotates in one direction, and rotate in one direction when the first main gear 373 rotates in the other direction. Thus, when the first shielding member 352 opens the first hole 351, the second shielding member 364 may shield the first space, and when the first shielding member 352 blocks the first hole 351, the second shielding member 364 may open the first space.

The first main gear 373 and the first sub-gear 374 may be engaged at a predetermined gear ratio. Thus, compared to the second shielding member 364 blocking the wide first space, the first shielding member 352 may shield the first hole 351 narrower than the first space. In an embodiment of the present disclosure, since the size of the first hole 351 is narrower than that of the first space, the amount of air and dust sucked from the outside may be improved by the Bernoulli effect.

The first opening/closing device 369 may include the second rotation gear 375. The second rotation gear 375 may be connected to the first belt 372. The second rotation gear 375 may be rotated by the first belt 372. Specifically, the second rotation gear 375 may be rotated in one direction or the other direction by the first belt 372. The second rotation gear 375 may be connected to the second shielding member 364. Specifically, the second rotation gear 375 may share a rotational axis with the second shielding member 364. The second rotation gear 375 may rotate the second shielding member 364 in one direction or the other direction. The second rotation gear 375 allows the second shielding member 364 to shield the first space when the first belt 372 rotates in one direction, and when the first belt 372 rotates in the other direction, the second shielding member 364 may allow the first space to be opened.

The cleaning module 340 may include the second opening/closing device 379. The second opening/closing device 379 may be disposed on the housing 342. The second opening/closing device 379 may be disposed in the housing 342. The second opening and closing device 379 may selectively open and close the second hole 361. The second opening/closing device 379 may be electrically connected to the controller 390. The second opening/closing device 379 may be operated by the controller 390 according to a user's operation signal.

The second opening/closing device 379 may include the third shielding member 362. The third shielding member 362 may be disposed in the housing 342. The third shielding member 362 may be disposed on the other side of the housing 342. The third shielding member 362 may be rotatably disposed in the housing 342. The third shielding member 362 may selectively open and close the second hole 361. The third shielding member 362 may open or block the second hole 361 by the second motor 380. The third shielding member 362 may be connected to the third rotation gears 383 and 384. The third shielding member 362 may open or block the second hole 361 by rotating according to the rotation of the third rotation gears 383 and 384. In an embodiment of the present disclosure, the third shielding member 362 is described by taking a rectangular shape as an example, but when the second hole 361 is able to be selectively opened and closed, the shape of the third shielding member 362 may be variously changed.

The second opening/closing device 379 may include the fourth shielding member 364. The fourth shielding member 354 may be disposed in the housing 342. The fourth shielding member 354 may be disposed on one side of the housing 342. Specifically, the fourth shielding member 354 may shield the second space between one side surface of the housing 342 and the central region of the suction space 344. When the third shielding member 362 opens the second hole 361, the fourth shielding member 354 shields the second space, so that the efficiency of sucking air and dust from one side of the housing 342 through the second hole 361 may be improved. In an embodiment of the present disclosure, the fourth shielding member 354 is described by taking a rectangular shape as an example, but when the second space is able to be shielded, the shape of the fourth shielding member 354 may be variously changed.

The second opening/closing device 379 may include the second motor 380. The second motor 380 may be connected to a second driving gear 381. Specifically, the second motor 380 may share a rotational axis with the second driving gear 381. The second motor 380 may rotate the second driving gear 381. For example, the second motor 380 may rotate the second driving gear 381 in one direction or rotate the same in the other direction.

The second opening/closing device 379 may include the second driving gear 381. The second driving gear 381 may be connected to the second motor 380. Specifically, the second driving gear 381 may share a rotational axis with the second motor 380. The second driving gear 381 may receive driving force from the second motor 380 to rotate in one direction or the other direction. The second driving gear 381 may be connected to the second belt 382. The second driving gear 381 may be wrapped from the second belt 382. The second driving gear 381 may rotate the second belt 382. Specifically, when the second driving gear 381 rotates in one direction, the second belt 382 may rotate in one direction, and when the second driving gear 381 rotates in the other direction, the second belt 382 may rotate in the other direction.

The second opening/closing device 379 may include the second belt 382. The second belt 382 may wrap the second driving gear 381, the third rotation gears 383 and 384, and the fourth rotation gear 385. The second belt 382 may rotate in one direction when the second driving gear 381 rotates in one direction, and rotate in the other direction when the second driving gear 381 rotates in the other direction. The second belt 382 may rotate the third rotation gears 383 and 384. Specifically, when the second belt 382 rotates in one direction, the second belt 382 may rotate the third rotation gears 383 and 384 in one direction, and when the second belt 382 rotates in the other direction, the second belt 382 may rotate the third rotation gears 383 and 384 in the other direction. The second belt 382 may rotate the fourth rotation gear 385. Specifically, when the second belt 382 rotates in one direction, the second belt 382 may rotate the fourth rotation gear 385 in one direction, and when the second belt 382 rotates in the other direction, the second belt 382 may rotate the fourth rotation gear 385 in the other direction. In an embodiment of the present disclosure, the second belt 382 is described by taking as an example a chain belt caught by each tooth of the second driving gear 381, the third rotation gears 383 and 384, and the fourth rotation gear 385, but is not limited thereto and may be variously changed.

The second opening/closing device 379 may include the third rotation gears 383 and 384. The third rotation gears 383 and 384 may be wrapped by the second belt 382. The third rotation gears 383 and 384 may be rotated by the second belt 382. Specifically, the third rotation gears 383 and 384 may rotate in one direction or the other direction by the second belt 382. The third rotation gears 383 and 384 may be connected to the third shielding member 362. Specifically, the third rotation gears 383 and 384 may share a rotational axis with the third shielding member 362. In the third rotation gears 383 and 384, when the second belt 382 rotates in one direction, the third shielding member 362 may shield the second hole 361, and when the second belt 382 rotates in the other direction, the third shielding member 362 may open the second hole 361. In an embodiment of the present disclosure, one direction may mean a clockwise direction and the other direction may mean a counterclockwise direction, but are not limited thereto.

The third rotation gears 383 and 384 may include a second main gear 383. The second main gear 383 may be wrapped by the second belt 382. The second main gear 383 may be rotated by the second belt 382. Specifically, the second main gear 383 may be rotated in one direction or the other direction by the second belt 382. The second main gear 383 may be engaged with a second sub-gear 384.

The third rotation gears 383 and 384 may include the second sub-gear 384. The second sub-gear 384 may be engaged with the second main gear 383. The second sub-gear 384 may be connected to the third shielding member 362. Specifically, the second sub-gear 384 may share a rotational axis with the third shielding member 362. The second sub-gear 384 may rotate in the other direction when the second main gear 383 rotates in one direction, and rotate in one direction when the second main gear 383 rotates in the other direction. Thus, when the third shielding member 362 opens the second hole 361, the fourth shielding member 354 may shield the second space, and when the third shielding member 362 blocks the second hole 361, the fourth shielding member 354 may open the second space.

The second main gear 383 and the second sub-gear 384 may be engaged at a predetermined gear ratio. Thus, compared to the fourth shielding member 354 blocking the wide second space, the third shielding member 362 may shield the second hole 361 narrower than the second space. In an embodiment of the present disclosure, since the size of the second hole 361 is narrower than that of the second space, the amount of air and dust sucked from the outside may be improved by the Bernoulli effect.

The second opening/closing device 379 may include the fourth rotation gear 385. The fourth rotation gear 385 may be connected to the second belt 382. The fourth rotation gear 385 may be rotated by the second belt 382. Specifically, the fourth rotation gear 385 may be rotated in one direction or the other direction by the second belt 382. The fourth rotation gear 385 may be connected to the fourth shielding member 354. Specifically, the fourth rotation gear 385 may share a rotational axis with the fourth shielding member 354. The fourth rotation gear 385 may rotate the fourth shielding member 354 in one direction or the other direction. The fourth rotation gear 385 allows the fourth shielding member 354 to open the second space when the second belt 382 rotates in one direction, and when the second belt 382 rotates in the other direction, the fourth shielding member 354 may allow the second space to be blocked.

The cleaning module 340 may include the first elastic member 353. The first elastic member 353 may be disposed in the housing 342. The first elastic member 353 may be disposed on one side of the housing 342. The first elastic member 353 may be disposed on one side surface of the housing 342. The first elastic member 353 may be disposed adjacent to the first hole 351. The first elastic member 353 may be disposed in a region surrounding the first hole 351. The first elastic member 353 may protrude to an outside of one side surface of the housing 342. The outermost side surface of the first elastic member 353 may be disposed on the same plane as the outermost side surface of the first roller 355. For example, the outermost side surface of the first elastic member 353 may be vertically overlapped with the outermost side surface of the first roller 355. Thus, since a vacuum effect is generated between a wall surface 8 and the first hole 351 due to the contact between the wall surface 8 and the first elastic member 353, the suction force can be improved. In addition, the first elastic member 353 may be formed of a material having elasticity to prevent damage to a product. In an embodiment of the present disclosure, the first elastic member 353 has been described as an example formed of a material having elasticity, but is not limited thereto and may be formed of a material having no elasticity. In this connection, the first elastic member 353 may be referred to as a "first vacuum member."

The cleaning module 340 may include the second elastic member 363. The second elastic member 363 may be disposed in the housing 342. The second elastic member 363 may be disposed on the other side of the housing 342. The second elastic member 363 may be disposed on the other side surface of the housing 342. The second elastic member 363 may be disposed adjacent to the second hole 361. The second elastic member 363 may be disposed in a region surrounding the second hole 361. The second elastic member 363 may protrude to an outside of the other side surface of the housing 342. The outermost side surface of the second elastic member 363 may be disposed on the same plane as the outermost side surface of the second roller 365. For example, the outermost side surface of the second elastic member 363 may be vertically overlapped with the outermost side surface of the second roller 365. Thus, since a vacuum effect is generated between the wall surface 8 and the second hole 361 due to the contact between the wall surface 8 and the second elastic member 363, the suction force can be improved. In addition, the second elastic member 363 may be formed of a material having elasticity to prevent damage to a product. In an embodiment of the present disclosure, the second elastic member 363 has been described as an example formed of a material having elasticity, but is not limited thereto and may be formed of a material having no elasticity. In this connection, the second elastic member 363 may be referred to as a "second vacuum member."

The cleaning module 340 may include the first roller 355. The first roller 355 may be disposed in the housing 342. The first roller 355 may be disposed on one side of the housing 342. The first roller 355 may be disposed on one side surface of the housing 342. The first roller 355 may protrude to an outside of one side surface of the housing 342. The first roller 355 may contact the wall surface 8. Thus, it is possible to prevent the wall surface 8 from directly contacting the housing 342 to prevent damage to a product.

The cleaning module 340 may include the second roller 365. The second roller 365 may be disposed in the housing 342. The second roller 365 may be disposed on the other side of the housing 342. The second roller 365 may be disposed on the other side surface of the housing 342. The second roller 365 may protrude to an outside of the other side surface of the housing 342. The second roller 365 may contact the wall surface 8. Thus, it is possible to prevent the wall surface 8 from directly contacting the housing 342 to prevent damage to a product.

The cleaning module 340 may include the operation unit 388. The operation unit 388 may be disposed in the cleaning module 340. Alternatively, the operation unit 388 may be disposed in the main body 310 of the cleaner 300 for user convenience. The operation unit 388 may receive an operation signal from the user. The operation unit 388 may be electrically connected to the controller 390. The operation unit 388 may provide the operation signal supplied from the user to the controller 390.

The cleaning module 340 may include the controller 390. The controller 390 may be disposed in the cleaning module 340. Alternatively, the controller 390 may be disposed in the main body 310 of the cleaner 300. The controller 390 may be electrically connected to the operation unit 388. The controller 390 may receive a user's operation signal from the operation unit 388. The controller 390 may be electrically connected to the first opening/closing device 369. The controller 390 may be electrically connected to the first motor 370. The controller 390 may drive the first opening/closing device 369 or the first motor 370 when receiving a first operation signal from the user. The controller 390 may be electrically connected to the second opening/closing device 379. The controller 390 may be electrically connected to the second motor 380. The controller 390 may drive the second opening/closing device 379 or the second motor 380 when receiving a second operation signal from the user. The controller 390 may independently drive the first opening/closing device 369 and the second opening/closing device 370, respectively.

A basic mode of the cleaning module 340 will be described with reference to FIGS. 6 to 10.

When a user operates the operation unit 388 in an N (neutral) mode, the first shielding member 352 may shield the first hole 351, the second shielding member 364 may open the first space, the third shielding member 362 may block the second hole 361, and the fourth shielding member 354 may open the second space. In this connection, air and dust from a bottom surface of the cleaning module 340 may be sucked according to a progress direction of the cleaner 300.

A first cleaning mode of the cleaning module 340 will be described with reference to FIGS. 11 to 14.

When a user operates the operation unit 388 in an L (left) mode, the controller 390 may drive the first opening/closing device 369. In this connection, the first shielding member 352 may open the first hole 351, and the second shielding member 364 may block the first space. In this connection, the third shielding member 362 is in a state in which the second hole 361 is blocked, and the fourth shielding member 354 is in a state in which the second space is opened. Thus, since air and dust between the left side of the cleaning module 340 and the wall surface 8 are sucked, the cleaning efficiency of the edge region of the cleaning space can be improved.

A second cleaning mode of the cleaning module 340 will be described with reference to FIGS. 15 to 18.

When a user operates the operation unit 388 in an R (right) mode, the controller 390 may drive the second opening/closing device 379. In this connection, the third shielding member 362 may open the second hole 361 and block the second space of the fourth shielding member 354. In this connection, the first shielding member 352 is in a state in which the first hole 351 is blocked, and the second shielding member 364 is in a state in which the first space is opened. Thus, since air and dust between the right side of the cleaning module 340 and the wall surface 8 are sucked, the cleaning efficiency of the edge region of the cleaning space can be improved.

A user may change from an L mode directly to an R mode and change from an R mode directly to an L mode.

As described above, the embodiments of the present disclosure have been described with reference to the accompanying drawings, but those skilled in the art to which the present disclosure pertains will understand that the present disclosure may be embodied in other specific forms without changing its technical spirit or essential features. Therefore, it would be understood that the embodiments described above are illustrative in all respects, and not limited thereto.

The invention claimed is:

1. A cleaning module comprising:

a housing communicating with a suction port of a main body of a cleaner, and comprising a suction space configured to be exposed to a bottom surface;

a first hole located on a first side surface of the housing perpendicular to a cleaning direction and configured to expose an inside of the housing; and a first opening/closing device including a first shielding member configured to enable communication with the suction space and an exterior of the first side surface by selectively opening/closing the first hole and a second shielding member configured to selectively open/close a first space between a second side surface of the housing perpendicular to the cleaning direction and a central region of the housing;

a second hole located on the second side surface perpendicular to the cleaning direction, and configured to expose the inside of the housing with respect to the suction space; and a second opening/closing device including a third shielding member configured to enable communication with the suction space and an exterior of the second side surface by selectively opening/closing the second hole and a fourth shielding member configured to selectively open/close a second space between the first side surface of the housing and the central region of the housing, wherein, when the first opening/closing device is in a first position, the first shielding member opens the first hole and the second shielding member closes the first space, and when the first opening/closing device is in a second position, the first shielding member closes the first hole and the second shielding member opens the first space, wherein, when the second opening/closing device is in a first position, the third shielding member opens the second hole and the fourth shielding member closes the second space, and when the second opening/closing device is in a second position, the third shielding member closes the second hole and the fourth shielding member opens the second space, and wherein the first opening/closing device and the second opening/closing device operate independently.

2. The cleaning module of claim 1, wherein the first opening/closing device further includes:

first rotation gears configured to rotate the first shielding member;

a first driving gear spaced apart from the first rotation gears;

a first belt wrapping the first rotation gears and the first driving gear; and a first motor configured to rotate the first driving gear.

3. The cleaning module of claim 2, wherein:

the first opening/closing device further includes a second rotation gear configured to rotate the second shielding member, and the first belt wraps the first rotation gears, the first driving gear, and the second rotation gear.

4. The cleaning module of claim 2, wherein the first rotation gears comprise:

a first main gear wrapped by the first belt; and a first sub-gear being engaged with the first main gear at a predetermined gear ratio and configured to rotate the first shielding member.

5. The cleaning module of claim 1, wherein the second opening/closing device further comprises:

third rotation gears configured to rotate the third shielding member;

a second driving gear spaced apart from the third rotation gears;

a second belt wrapping the third rotation gears and the second driving gear; and a second motor configured to rotate the second driving gear.

6. The cleaning module of claim 5, wherein:

the second opening/closing device further comprises a fourth rotation gear configured to rotate the fourth shielding member; and the second belt wraps the third rotation gears, the second driving gear, and the fourth rotation gear.

7. The cleaning module of claim 5, wherein the third rotation gears comprise:

a second main gear wrapped by the second belt; and a second sub-gear which is engaged with the second main gear at a predetermined gear ratio and configured to rotate the third shielding member.

8. The cleaning module of claim 1, comprising a first roller disposed on one side of the housing.

9. The cleaning module of claim 1, comprising a first elastic member disposed adjacent to the first hole and protruding outward from the first side surface of the housing, wherein an outer side surface of the first elastic member is in contact with a wall surface.

10. A cleaner comprising:

a main body including a suction port;

an extended pipe communicating with the suction port; and a cleaning module communicating with the extended pipe, wherein the cleaning module comprises:

a housing communicating with the suction port, and including a suction space configured to be exposed to a bottom surface;

a first hole located on a first side surface of the housing perpendicular to a cleaning direction, and configured to expose an inside of the housing; and a first opening/closing device configured to enable communication with the suction space and an exterior of the first side surface by selectively opening/closing the first hole, wherein the first opening/closing device includes a first shielding member configured to enable communication with the suction space and the exterior of the first side surface by selectively opening/closing the first hole and a second shielding member configured to selectively open/close a first space between a second side surface of the housing perpendicular to the cleaning direction, and a central region of the housing;

a second hole located on the second side surface of the housing perpendicular to the cleaning direction, and configured to expose the inside of the housing with respect to the suction space; and a second opening/closing device configured to enable communication with the suction space and an exterior of the second side surface by selectively opening/closing the second hole, wherein the second opening/closing device includes a third shielding member configured to enable communication with the suction space and the exterior of the second side surface by selectively opening/closing the second hole and a fourth shielding member configured to selectively open/close a second space between the first side surface of the housing and the central region of the housing, wherein, when the first opening/closing device is in a first position, the first shielding member opens the first hole and the second shielding member closes the first space, and when the first opening/closing device is in a second position, the first shielding member closes the first hole and the second shielding member opens the first space, wherein, when the second opening/closing device is in a first position, the third shielding member opens the second hole and the fourth shielding member closes the second space, and when the second opening/closing device is in a second position, the third shielding member closes the second hole and the fourth shielding member opens the second space, and wherein the first opening/closing device and the second opening/closing device operate independently.

* * * * *